US005318112A

United States Patent [19]

Gopin

[11] Patent Number: 5,318,112

[45] Date of Patent: Jun. 7, 1994

[54] FINNED-DUCT HEAT EXCHANGER

[75] Inventor: Stanislav Gopin, Kiriat Gat, Israel

[73] Assignee: Raditech Ltd., Kiriat Gat, Israel

[21] Appl. No.: 25,146

[22] Filed: Mar. 2, 1993

[51] Int. Cl.[5] ..... F28D 1/04; F28F 1/02; F28F 1/18

[52] U.S. Cl. ..... 165/151; 165/182; 165/910

[58] Field of Search ..... 165/151, 182, 910

[56] References Cited

U.S. PATENT DOCUMENTS

| | | | |
|---|---|---|---|
| 2,006,649 | 7/1935 | Modine | 165/151 X |
| 2,028,458 | 1/1936 | Karmozin | 165/151 X |
| 2,045,657 | 6/1936 | Karmozin | 165/182 X |

FOREIGN PATENT DOCUMENTS

| | | | |
|---|---|---|---|
| 2449145 | 4/1976 | Fed. Rep. of Germany | 165/151 |
| 983431 | 3/1981 | U.S.S.R. . | |
| 1128093 | 12/1984 | U.S.S.R. | 165/151 |
| 398110 | 9/1933 | United Kingdom | 165/151 |
| 513199 | 10/1939 | United Kingdom | 165/151 |

OTHER PUBLICATIONS

Transactions of the ASME; May 1966; p. 182.

*Primary Examiner*—Allen J. Flanigan

*Attorney, Agent, or Firm*—Frishauf, Holtz, Goodman & Woodward

[57] ABSTRACT

A finned heat exchanger for increased heat transfer from liquid to air, includes of a plurality of stacked thin plates of conductive metal sheeting which are provided with stamped and drawn, slightly conical collars of elliptical, oval or other oblong cross section. The plates are stacked and assembled with the collars of each sheet forcefully pushed into the collars of the adjoining plate, thus effecting tightly closed ducts for the passage of the liquid. The thus-created ducts are arranged in rows and columns, wherein the long axes of the oblong cross section are inclined towards the center line of each column at an angle of 12°-16° to the left and to the right in alternate columns, and wherein the ducts in the rows are staggered in the direction of air flow, every second duct being disposed in forward direction by about half the length of the long axis of its cross section.

12 Claims, 4 Drawing Sheets

FINNED-DUCT HEAT EXCHANGER

BACKGROUND OF THE INVENTION

The invention relates to a finned-duct heat exchanger serving to transfer heat energy between a liquid flowing through the ducts and between air or gas caused to flow through the spaces between the fins. It relates particularly to a heat exchanger comprising a plurality of parallel closely stacked metal plates, each plate being provided with a plurality of protruding oblong conical collars, wherein the collars of each plate inserted into the collars of the adjoining sheet form continuous parallel ducts extending through the metal plates forming the fins of the heat exchanger. It furthermore relates to a heat exchanger wherein the axes of said oblong ducts are positioned at an angle to the direction of the flow of air or gas with the object of improving heat transfer and, on the other hand, reducing the flow resistance to the gas or air blown through the heat exchanger.

Although the heat exchanger to be described is suitable for any kind of gas flowing between the fins, including air, the expression "air" will be used in the following to describe any gaseous medium flowing through the exchanger, while the expression "liquid" will be used for any fluid, liquid or gaseous, made to flow through the ducts.

The inventor of the present heat exchanger is the owner of an inventor's certificate No. 983431, issued in USSR, disclosing a finned tube-less heat exchanger of the kind which has plurality of oblong finned ducts arranged in parallel rows perpendicular to the direction of air-flow, with their axes alternately inclined at equal angles to the direction of air-flow, thereby creating alternate converging and diverging air channels between pairs of adjoining ducts. Although this arrangement of ducts increases the heat transfer per unit area compared with the conventional finned-tube heat exchangers, it has the inherent drawback that certain portions of the air flow in reverse direction, mostly in the diverging air channel portions from higher to lower pressure zones, as illustrated in FIG. 1 of the drawings. This backflow results in stagnant air flow in the areas at the downstream ends of the ducts, where heat transfer is much lower than along the surfaces with rapid air flow. This type of flow evidently causes higher flow resistance and reduced heat transfer, and it is the main object of the present invention to obviate these drawbacks, as far as possible.

Tests with various arrangements of finned-tube heat exchangers are described in volume 182 of May 1966 of the Transactions of the ASME. These tests were carried out with oblong tubes having their axes aligned in the direction of air flow, and they showed that specific performance was the highest with staggered arrangement of the tubes, especially if turbulators were provided on the fins. These tests are quoted here, since a similar arrangement of ducts is employed in the heat exchanger of the present invention.

The present invention has the above-mentioned objects to reduce flow resistance and to increase heat transfer, and in addition to facilitate production of this kind of heat exchanger by obviating the necessity of sealing the connections between the duct portions of the metal plates by soldering or otherwise, as employed with the conventional type of tube-less heat exchangers.

The design of the heat exchanger according to the present invention is most suitable in the manufacture of radiators for motor vehicles, or of condensors and evaporators in air conditioning units, and in any other equipment designed for the exchange of heat energy between a gas and a liquid.

SUMMARY OF THE INVENTION

A preferred embodiment of the finned heat exchanger of the present invention comprises plurality of parallel fins in the form of thin plates of heat-conductive metal sheeting, each provided with a plurality of stamped and deep-drawn conical collars of oblong cross section protruding from one side of the plates; the plates are assembled to form a finned exchanger by inserting and pressing the collars of each plate into the collars of the adjoining plate, thus creating continuous ducts perpendicular to the planes of the plates and effecting alignment of the plates with narrow interspaces. The ducts are arranged in rows and columns disposed at right angles, the columns extending parallel to the direction of the idealized air flow through the heat exchanger, while the ducts in the rows are staggered by between a third and a half of the long axis of the oblong cross section, viz. are arranged in zigzag-shape. The long axes of the ducts are inclined to the center line of the columns at an angle of between 12° and 16°, to the left and to the right in alternate columns, thus forming converging flow paths which prevent stagnant flow areas at the downstream ends of the ducts and increase heat transfer all over their circumference.

The cross section of the collars—and of the resulting ducts—is either elliptical, oval or in the shape of an oblong with parallel sides and rounded end portions. In fact, any oblong cross section would be suitable that presents a minimum flow resistance, such as an aerodynamic profile. The depth of the collars is relatively large compared with the width of the ellipse, the oval or oblong, which is obtained by means of repeated deep-drawing operations; this depth is preferably three times the distance between adjoining plates, resulting in triple wall thickness of the ducts, while the angle of their cone is approximately 8°. This angle and the fact of the triple thickness provides perfect sealing of the ducts against escape of gas and makes any other method of sealing unnecessary, different from the manufacture of conventional tube-less heat exchangers which have to be soldered or electro-plated.

In order to increase heat transfer by creating turbulent air flow, the plates are preferably provided with upstanding turbulators as known to the art.

As an alternative the collars may be of short depth, and tubes of corresponding cross section may be pressed through the holes in the plates, wherein the collars cause improved contact areas between tubes and fins for improved heat transfer, as known to the art.

DETAILED DESCRIPTION OF THE DRAWINGS

Figure 1:
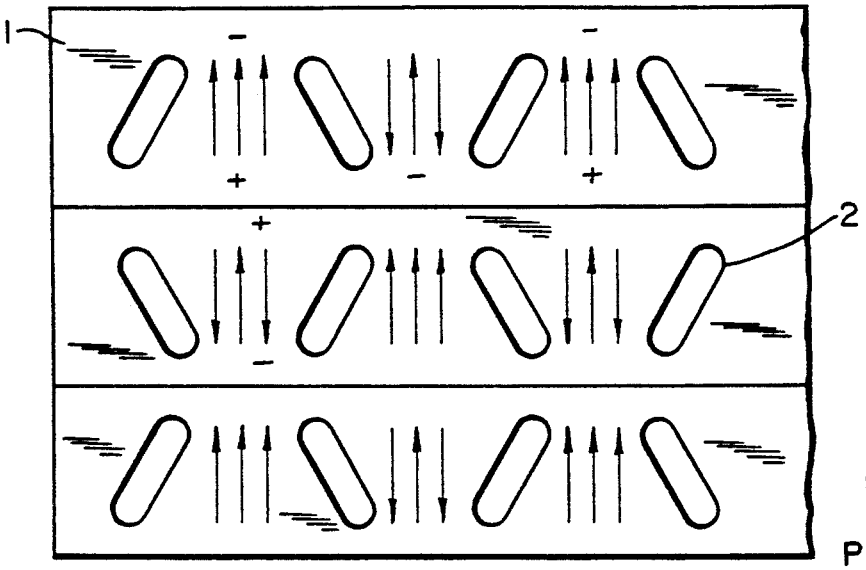
FIG. 1 PRIOR ART
FIG. 1 is a flow diagram through a heat exchanger of the kind disclosed in USSR Patent No. 983431, showing backflow and stagnating flow areas.

In the arrangement of the ducts illustrated in FIG. 1, as disclosed in USSR Patent 983431, the flow converges and diverges alternately on its way through the heat exchanger resulting in areas of higher and lower pressures as indicated by the signs (+) and (−). The pressure gradient from high to low causes a small portion of the air to flow in reverse direction to the main flow induced by a blower as shown by the arrows. This reverse flow gives rise to stagnant areas, especially at the downstream ends of the ducts, with reduced heat transfer.

Figure 2:
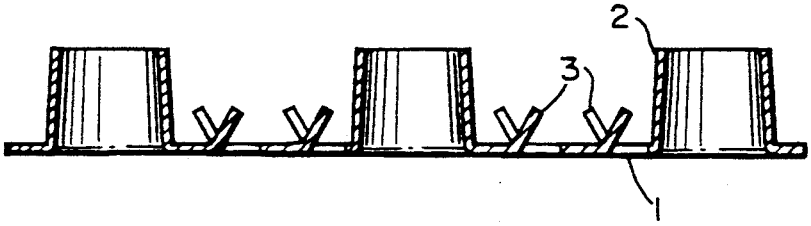
FIG. 2 is a section of a sheet fin with four deep-drawn collars of elliptical cross section.
Figure 3:
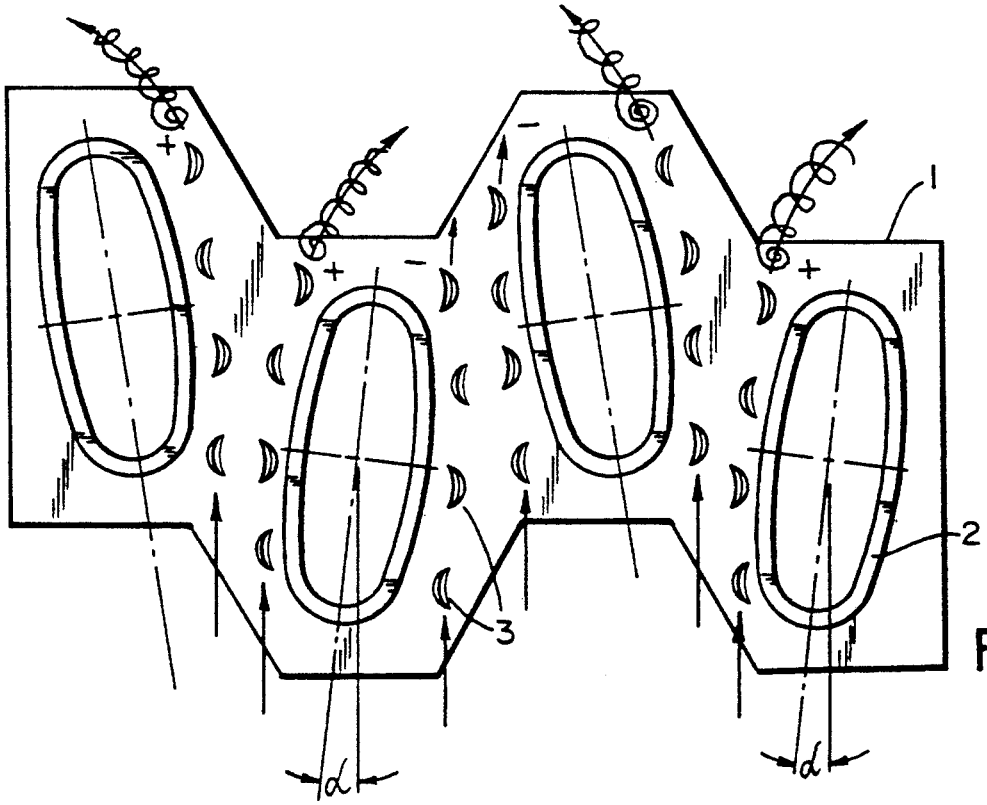
FIG. 3 is a plan view of the sheet shown in FIG. 2, showing the improved air flow.
Figure 4:
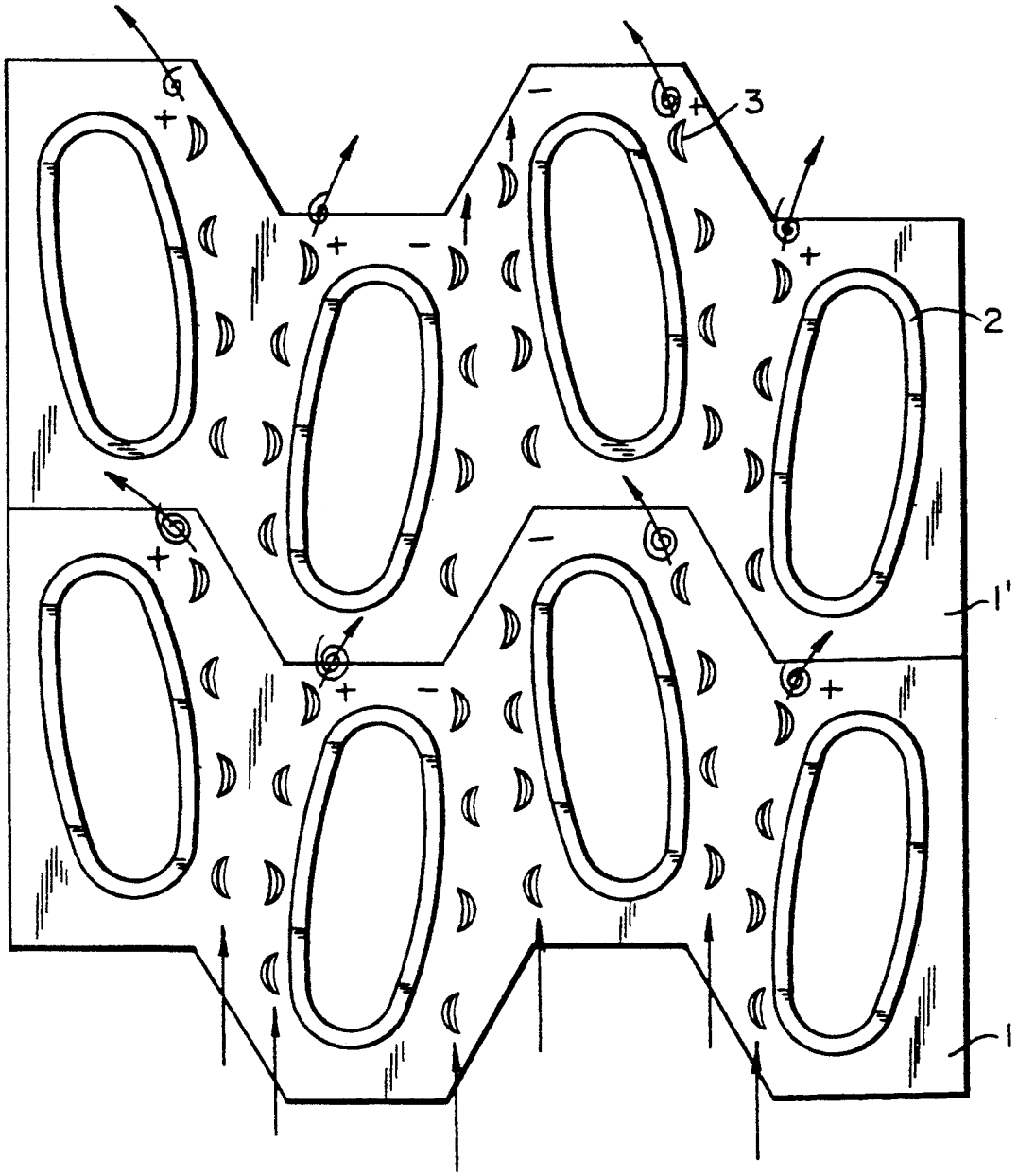
FIG. 4 is a plan view of two rows of ducts and the improved air flow therethrough.

FIGS. 2 and 3 illustrate a plate 1 with four collars 2 pressed out of the plate by deep-drawing operations. The collars are of oblong elliptical cross section and are arranged in the plate in staggered alignment, with every other collar shifted in downstream direction by about half the length of its long axis. These axes are inclined alternately to the right and to the left of the main air flow by an angle "$\alpha$" whereby diverging flow is prevented. This feature can be more distinctly discerned in FIG. 4 which shows two plates 1 and 1′ positioned next to each other, and wherein the air flow is indicated by arrows. Owing to the inclination of the duct axes the air flow is not straight between adjoining columns, but moves to the right and to the left between successive ducts, the flow showing no diverging portions. As illustrated in FIGS. 3 and 4, the plates are cut in zigzag fashion in order to bring the staggered ducts into close alignment, which with rectangular plates would be far removed from each other resulting in a heat exchanger of greater width. The plates are provided with turbulators 3 punched out of the sheet material in a manner known to the art.

Figure 5:
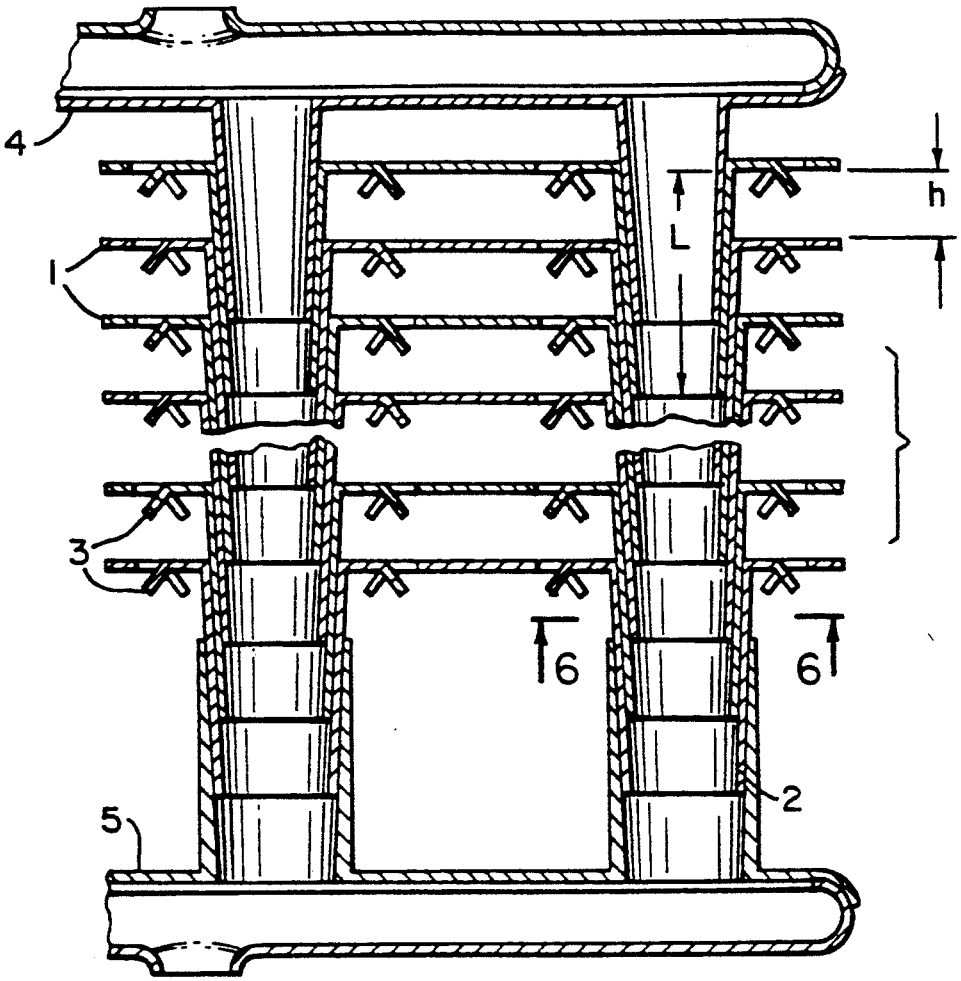
FIG. 5 is a flow diagram through a heat exchanger assembled from sheets designed and manufactured in accordance with the present invention.
Figure 6:
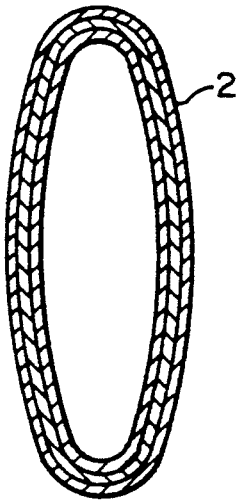
FIG. 6 is a section along line A—A of FIG. 5, and FIGS. 7A, 7B and 7C illustrate the turbulators and their angular position relative to the air flow.

FIG. 5 shows a portion of a heat exchanger assembled from six plates 1, an upper collector 4 and a lower collector 5. The collars 2 are of a length L which is about three times the distance h between adjoining plates whereby the thickness of the ducts is three times the thickness of a single collar, as shown in FIG. 6.

Figure 7A:
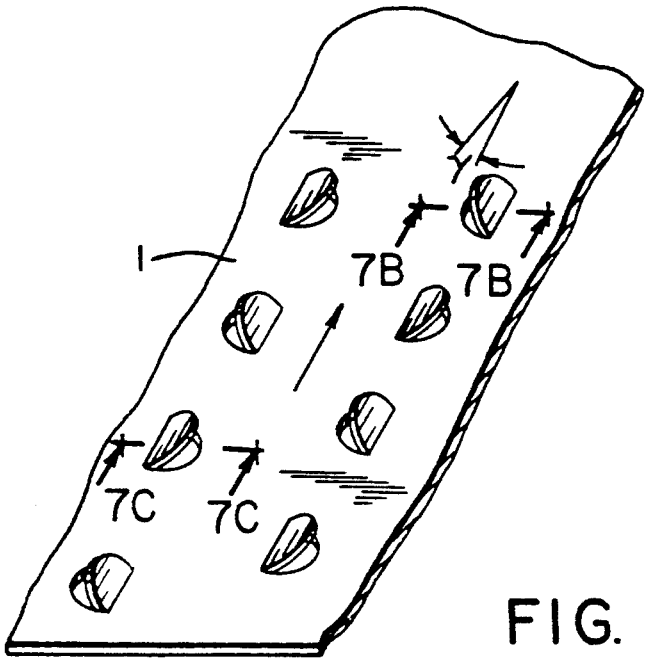
Figure 7B:
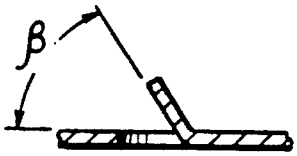
Figure 7C:
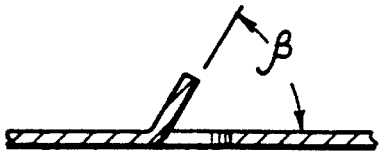

FIGS. 7A, 7B and 7C illustrate the turbulators stamped out of the sheet material, the sections of FIGS. 7B and 7C showing the angle "$\beta$" at which they are inclined to the plane of the sheet; this angle may be varied between 45° and 60°, while the inclination of the turbulator planes in relation to the air flow, as indicated by the angle "y" may be varied between 10° and 15°.

As mentioned before, the invention is not limited to the manner of manufacturing a heat exchanger as described in the foregoing; as an alternative a heat exchanger may include tubes of oblong, oval or elliptical cross section inserted into flanged plates in rows and columns, wherein the tubes in rows are staggered at a rate of about 0.3 to 0.5 of the length of the long axis of the cross section of the tubes, and wherein the long axes of their cross section in alternate columns are inclined to the left and to the right of the main flow by an angle of between 12° and 16°. The distance between ducts is at least of a magnitude of half the length of the short axis of the duct cross section, and may be increased in accordance with heat transfer requirements.

In a preferred embodiment the plates are of an initial thickness of between 0.05 and 0.5 mm, and are assembled at a distance of from 0.5 to 5 mm. The angular inclination "$\alpha$" of the ducts in respect of the direction of the columns and the direction of the idealized air flow lies between 12° and 16°.

I claim:

1. A finned heat exchanger comprising a plurality of metal plates in close parallel alignment and a plurality of ducts extending in a perpendicular direction through said plates, wherein, said ducts are arranged in parallel rows and in parallel columns perpendicular to said rows and wherein said ducts are of oblong cross section with their long axes inclined to the center line of each column at an angle of between 12° and 16°, the inclination of said ducts being to the left and to the right of said center line in alternate columns, wherein said ducts in said rows are staggered, each second duct being disposed in the direction of air flow by a distance corresponding to one third to one half the length of said long axis of said oblong cross section, said plates are provided with stamped out collars surrounding holes in the shape of said ducts and wherein said plates are stacked in identical spaced parallel alignment, and wherein the ends of said ducts are connected to collector means.

2. The finned heat exchanger of claim 1, wherein said ducts are of elliptical cross section.

3. The finned heat exchanger of claim 1, wherein said ducts are of oval cross section.

4. The finned heat exchanger of claim 1, wherein said ducts are of aero-dynamic cross section in the direction of air flow.

5. The finned heat exchanger of claim 1, wherein said ducts are of oblong cross section, said oblong including two substantially parallel sides and two rounded end portions.

6. The finned heat exchanger of claim 1, wherein each said plate is provided with a plurality of conical collars arranged in rows and columns protruding from one of its sides to a greater depth than the distance between two said plates and wherein said ducts are formed by said collars of one plate inserted into the collars of the adjoining plate.

7. The finned heat exchanger of claim 6, wherein said conical collars are of a depth at least equal to three times the distance between two said plates, forming ducts of a wall thickness three times the thickness of the wall of one collar.

8. The finned heat exchanger of claim 7, wherein the angle formed by the cone of each said collar is about 8°.

9. The finned heat exchanger of claim 1, wherein said plates are provided with turbulators protruding from one side of each said plate.

10. The finned tube exchanger of claim 1, wherein said plates are made of a conductive sheet metal of a thickness between 0.05 and 0.5 mm.

11. The finned heat exchanger of claim 1, wherein the distance between adjoining ducts is between 0.5 and 5 mm.

12. The finned heat exchanger of claim 1, wherein said ducts are formed by short collars of oblong cross section, stamped and drawn out of said plates.

* * * * *